United States Patent [19]

Stitcher

[11] Patent Number: 4,726,804

[45] Date of Patent: Feb. 23, 1988

[54] METHOD AND APPARATUS FOR FABRICATING CONTINUOUS ENVELOPES

[75] Inventor: Robert S. Stitcher, Lewisville, N.C.

[73] Assignee: Wesley Business Forms, Winston-Salem, N.C.

[21] Appl. No.: 856,791

[22] Filed: Apr. 28, 1986

[51] Int. Cl.[4] ..... B31B 1/14

[52] U.S. Cl. ..... 493/223; 493/229; 493/230; 493/238; 493/266; 493/917; 83/49; 83/346

[58] Field of Search ..... 493/11, 220, 223, 227–230, 493/237, 238, 241, 265, 266, 917, 380, 381, 224, 346, 378; 83/49, 343, 346, 347

[56] References Cited

U.S. PATENT DOCUMENTS

| | | | |
|---|---|---|---|
| 1,310,922 | 7/1919 | Novick | 83/346 |
| 2,289,336 | 7/1942 | Bamford | 493/380 |
| 2,291,841 | 8/1947 | Staude | 493/380 |
| 2,332,544 | 10/1943 | Winkler et al. | 493/266 |
| 2,643,579 | 6/1953 | Jacoby | 83/915.5 |
| 2,645,166 | 7/1953 | Blizard | 493/266 |
| 2,722,369 | 11/1955 | Reuter | 229/69 |
| 2,790,593 | 4/1957 | Reuter | 229/69 |
| 2,824,685 | 2/1958 | Patton | 229/69 |
| 2,824,686 | 2/1958 | Hamilton | 229/69 |
| 2,847,915 | 8/1958 | Rapp | 493/220 |
| 2,996,962 | 8/1961 | Winkler et al. | 493/380 |
| 3,026,018 | 3/1962 | Stratton et al. | 229/69 |
| 3,219,258 | 11/1965 | Reuter | 229/69 |
| 3,404,607 | 10/1968 | Feick et al. | 493/373 |
| 3,547,343 | 12/1970 | Alton | 229/69 |
| 3,565,728 | 2/1971 | Alton | 229/69 |
| 3,630,122 | 12/1971 | Chamber | 83/49 |
| 4,066,206 | 1/1978 | Peterson | 229/69 |
| 4,102,251 | 7/1978 | Steidinger | 493/223 |
| 4,270,910 | 6/1981 | Himmelsbach | 493/373 |

*Primary Examiner*—Frederick R. Schmidt
*Assistant Examiner*—Robert Showalter
*Attorney, Agent, or Firm*—Bell, Seltzer, Park & Gibson

[57] ABSTRACT

A method and apparatus for fabricating continuous envelopes for use in connection with electronic data processing printers or the like is disclosed. The method and apparatus includes the steps of severing an advancing web along longitudinally spaced-apart transverse lines to provide straight completely severed segments and a non-severed medial segment. In a distinct step, the web is severed along non-linear lines adjacent to the transverse lines, with each non-linear line including a severed longitudinal segment and a severed bridging segment which extends in an oblique direction between the transverse line and the outer end of the associated longitudinal segment to provide a generally triangular cut-out which, when both are removed, yields an envelope backing panel having a tapered closure flap. Rectangular patch portions are then adhered to the formed envelope backing panels, and wherein a second continuous web is advanced and severed along alternating first and second lines to produce alternating envelope patch portions and scrap portions. The resulting patch portions are advanced, without interruption, and accurately applied to the advancing backing panels.

21 Claims, 19 Drawing Figures

METHOD AND APPARATUS FOR FABRICATING CONTINUOUS ENVELOPES

BACKGROUND OF THE INVENTION

This invention relates to the fabrication of continuous envelopes, and more particularly to a method and apparatus for manufacturing envelopes which are adapted for use with electronic data processing printers or the like.

The demand for continuous envelopes is based in large measure on the ease by which standardized correspondence is simultaneously distributed to a large number of distinct individuals in an economic manner. The user need only maintain a computerized master listing which in turn is used with electronic printers to economically and rapidly generate pre-addresed envelopes or mailers for distribution. The problem is, however, that the recipient is generally well aware that the piece of correspondence has in fact been distributed to many others since the construction of the envelope itself will indicate this fact. Indeed, many charitable solicitations or other correspondence may even be discarded unopened because the recipient does not want to be bothered with so-called "junk mail," when the enclosures would otherwise merit their interest and attention.

The extensive efforts to emulate the appearance of the conventional folded envelope, while obtaining the advantages of computerized addressing, are reflected widely in the art. A representative prior continuous envelope construction is depicted in U.S. Pat. No. 3,026,018. As can be seen by reference to the drawings in that patent, envelopes which are fabricated from a continuous paper web in accordance with known methods have characteristic small triangular cut-outs on the backing panels to form a generally rectangular closure flap and in turn an overall rectangular appearance for the envelopes, as distinguished from the tapered appearance of the closure flap to an apex on an envelope manufactured by conventional means, i.e. by folding a precut, discrete form or blank. As disclosed in the above patent, a die cutting operation may be employed to form the small triangular cut-outs. However, a die cutting operation has not been found to be suitable for forming larger cut-outs of elongate triangular outline which would permit the closure flap to more closely approximate the appearance of the flap of a conventional envelope, since the larger die blades are expensive, and they are not able to uniformly sever cut-outs of elongate, relatively narrow triangular outline.

Since commercial manufacturers of continuous envelopes have lacked a satisfactory method for forming generally acceptable envelopes from a continuous paper web, they have turned to forming discrete and essentially conventional envelopes from blanks which are thereafter mounted on a distinct carrier sheet or alternatively glued together in series so that they may be advanced through an electronic printer. While the resultant product does resemble a conventional envelope for readily apparent reasons, these methods are very costly and inefficient. In this regard, U.S. Pat. Nos. 2,824,686; 3,219,258; 3,547,343 and 3,565,728 are representative. A still further effort in this field is represented by U.S. Pat. Nos. 2,790,593 and 4,102,251. In accordance with the methods described in these patents, discretely formed envelope backing panels or "ply segments" are adhered to a continuous web of "patch portions." The problems with this approach which are set forth in part in the latter reference, reside in accurately indexing the discrete ply segments onto the continuous web of envelope patches. Moreover, the resulting envelope product noticeably bears the dubious and telltale indicia of the conventional continuous envelope with all of the attendant disadvantages as described above.

In addition to providing a continuous envelope product having a suitable backing panel construction, it is also desirable to provide an envelope patch for application to the backing panels which includes an insert slot for facilitating the insertion of the correspondence or mailer by conventional automated equipment. As in the case of the envelope backing panels, it would be particularly desirable to manufacture these patches from a continuous paper web both from the standpoint of economy and precision. To date, however, no satisfactory method or apparatus to accomplish these objectives has been achieved. Instead, the prevailing methods in use utilize a totally rectangular patch (with no slot) which is discretely formed and then applied by gripper means, which lift a single, discrete patch, and then deposit it on an envelope backing panel as the stream of previously formed envelope backing panels is advanced. This procedure leads to significant indexing problems and creates a significant limitation on the overall speed of the envelope fabrication process.

It is therefore an object of the present invention to provide a method and apparatus for efficiently manufacturing continuous envelopes which are adapted for use with electronic data processing printers or the like, and which overcome the disadvantages and limitations of the prior practices.

It is a more particular object of the present invention to provide a method and apparatus for fabricating continuous envelopes, and which is adapted to provide for the effective formation of relatively large, elongate rectangular cut-outs in an advancing web of paper and so that the flap portions of the resulting envelopes may have the appearance of the flap portions of conventional envelopes.

It is also an object of the present invention to provide a method and apparatus for forming generally rectangular envelope patch portions, preferably having an insert slot, which are also formed from a continuous paper web and which may be accurately advanced and adhered to a continuous web of the backing panels, and so that the resulting envelopes further resemble conventional envelopes in appearance as well as function.

It is another object of the present invention to provide a method and apparatus which accomplishes the foregoing objects at relatively high operating speeds without compromising the high quality of the products.

SUMMARY OF THE INVENTION

The objects of the present invention are achieved by a method and apparatus of fabricating continuous envelops which includes the steps of advancing a web of sheet material along a path of travel and severing the web along longitudinally and regularly spaced apart transverse lines so that each line includes straight completely severed segments adjacent each of the ends of the line and a non-severed medial segment. The transverse lines define generally rectangular backing panels having longitudinal opposite side edges and which are interconnected to each other by the non-severed medial segments. In a distinct step, the web is severed along a non-linear line adjacent each of the ends of each transverse line. Each of the two non-linear lines includes a completely severed longitudinal segment and a completely severed bridging segment which extends in an oblique direction between the transverse line and the outer end of the associated longitudinal segment to provide a generally triangular cut-out. The two resulting cut-outs are on the same side of the associated transverse line, and are mirror images of each other, so as to yield a tapered closure flap. A rectangular patch portion is then adhered to each of the envelope backing panels to form an envelope pocket which opens along the top edge of the patch portion.

The two step procedure for forming the cut-outs in accordance with the present invention, has been found to permit the formation of cut-outs of elongate, relatively narrow triangular outline in a continuous web which extend across a substantial portion of the width of the resulting envelope. As a result, the closure flap of these envelopes may be shaped to closely resemble closure flaps of conventional envelopes.

The rectangular patch portions are adhered to the advancing web of serially arranged envelope backing panels, which are preferably formed as described above, by a method and apparatus which includes advancing a second web that is severed along alternating first and second transverse lines to produce alternating envelope patch portions and scrap portions. The resulting envelope patch portions continue to advance without interruption, and the patch portions are then positioned serially on the first web of advancing backing panels to form the desired continuous envelope product. Thus the patch portions are positively guided from the moment of their formation until they are placed on the advancing first web so that their proper alignment is assured, and while maintaining a high speed operation.

BRIEF DESCRIPTION OF THE DRAWINGS

Additional features and attendant advantages of the invention will be described in detail hereinbelow in connection with the drawings in which.

DETAILED DESCRIPTION

Figures 1, 2, 3, 4:
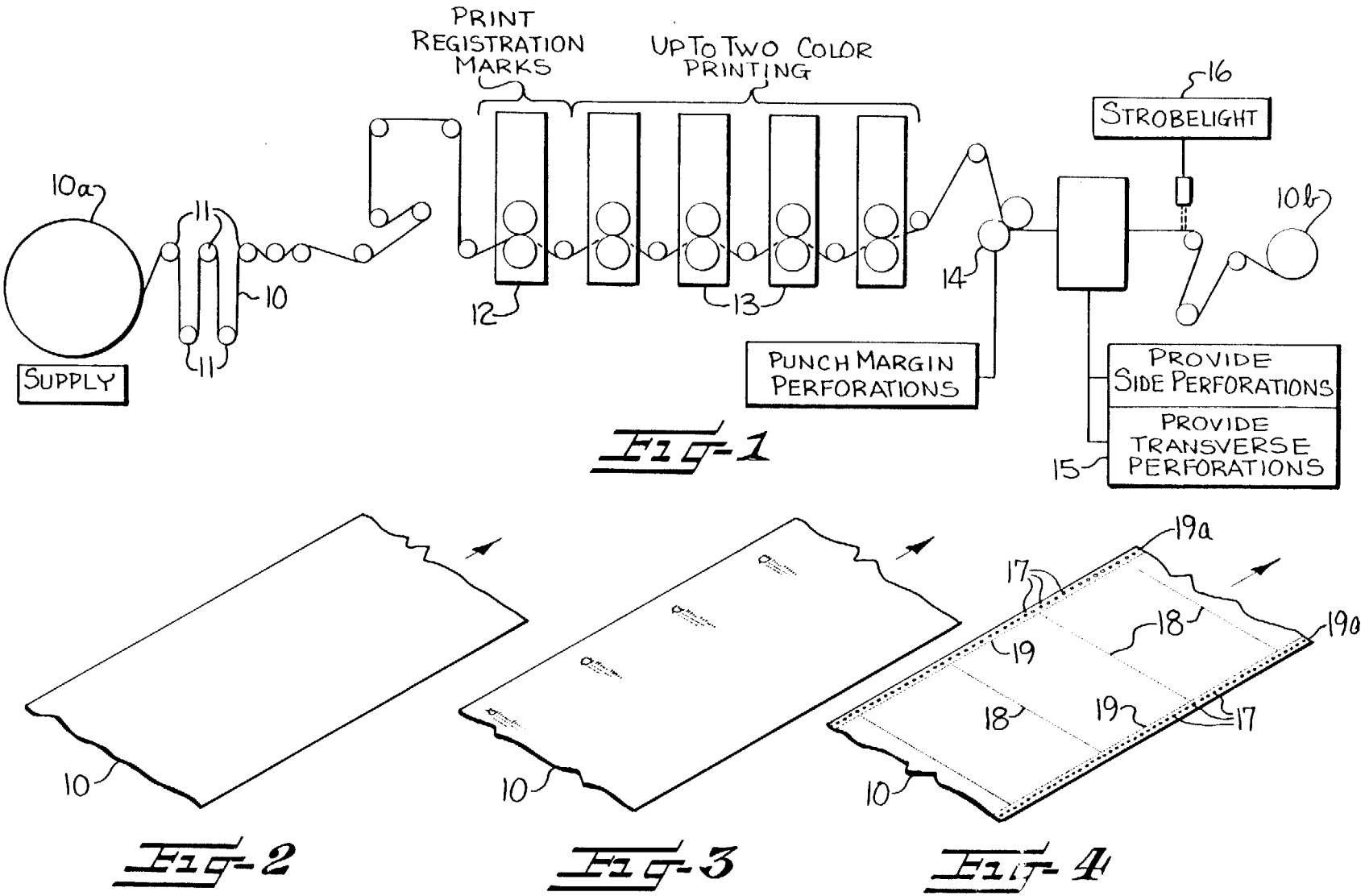
FIG. 1 is a schematic side view depicting the partial processing of a paper, web for forming envelope backing panels in with the invention.
FIGS. 2–4 are perspective views depicting the appearance of the paper web at intermediate stages as it advances from left to right through the various steps depicted schematically in FIG. 1, with FIG. 3 depicting the printed side of the backing panels and FIG. 4 depicting the opposite side.
Figure 5:
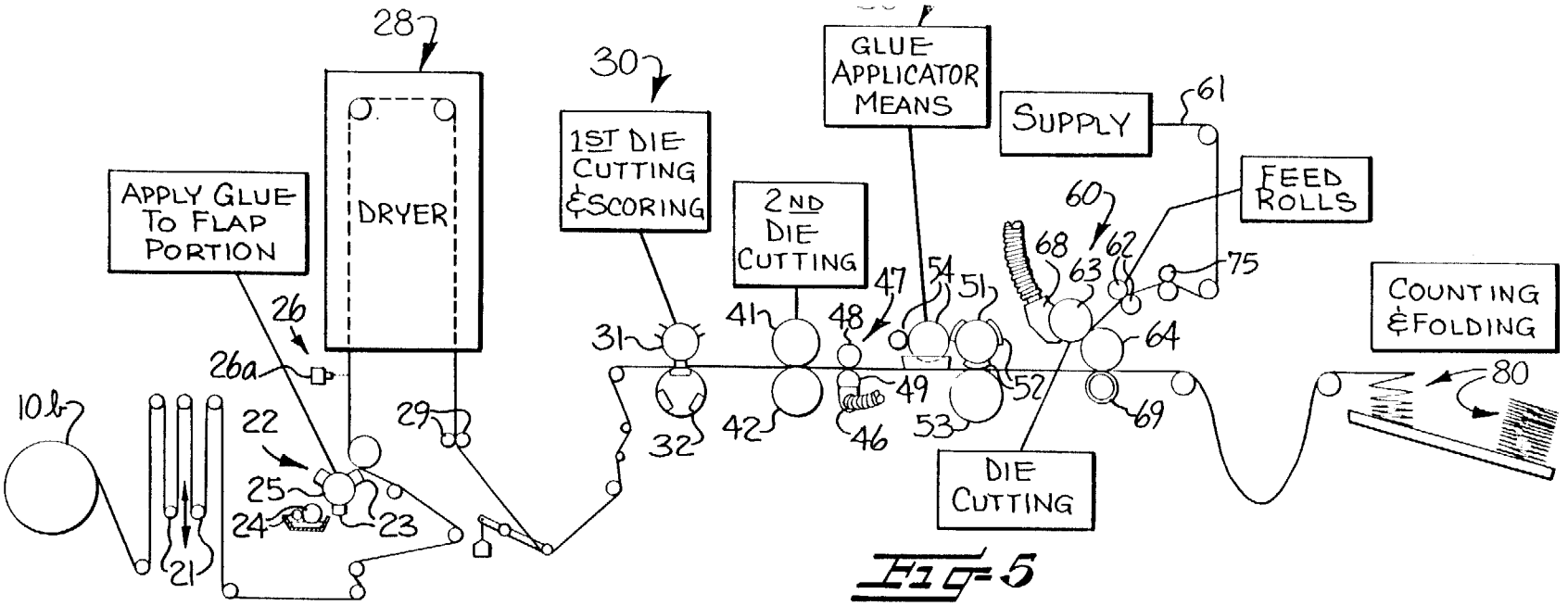
FIG. 5 is a schematic side view depicting additional steps of the novel method for forming serially connected envelope backing panels and further depicts the method for forming the patch portion for integration with the envelope backing panels to form the novel continuous envelope product.

The preferred method of manufacturing the desired continuous envelope product begins with initiating the formation of serially connected envelope backing panels as shown in FIG. 1, with the process continuing at FIG. 5. In the preferred initial phase of that fabrication, which is preferably performed on a business forms printing press, a first paper web 10 advances from a supply roll **10*a* through a plurality of dancing rolls 11 designed to equalize the tension in the web whereupon registration indicia or marks are preferably printed on the web by printing means 12, which indicia may be read preferably by an electric eye or other suitable process monitoring means for reasons discussed more fully hereinbelow. A logo or return address may then be optionally printed on the paper web 10 by conventional printing means 13 (FIG. 3**) where the envelopes are customized for use by a particular account.

In the initial processing, marginal perforations 17 (FIG. 4) which are adapted for receiving the pins on the tractor feed of a conventional electronic printer are also provided in the web, preferably by rotary punching means 14, which are known in the art. In addition, side and transverse perforating means 15 perforate the web to provide side perforations 19 defining marginal edge portions 19A, and transverse perforations 18 in the web 10 (FIG. 4). The transverse perforations 18 preferably extend along the full width of the web 10, including the marginal edge portions, to define lines of separation for discrete units as described below. A strobe light 16 is also preferably provided so that the proper placement of the preferred registration indicia by the printing means 12 may be monitored by an operator despite the relatively high speed of operation associated with conventional presses.

Figure 6:
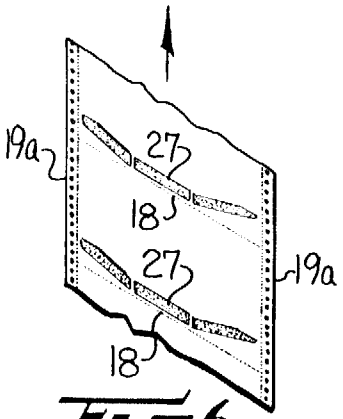

Following the preliminary processing, the perforated web 10 is then preferably wound into an intermediate roll **10*b* which is mounted on a second apparatus as illustrated in FIG. 5** for further processing in accordance with the present method. It should be noted that separate preliminary processing may not be required in most settings and that indeed many of the steps depicted schematically in FIG. 1, and notably the steps of perforating the web, may be performed on-line, or indeed concurrently with, various of the process steps to be described hereafter. The printed envelopes, however, are desirably processed in two "stages" to ensure precision. In any event, and as shown schematically in FIG. 5, the paper web 10 is withdrawn from the roll 10*b* and tension is again preferably equalized through the use of dancing rolls 21 whereupon remoistenable adhesive is preferably applied to the web in the closure flap area by pattern adhesive application means 22 (FIG. 10) followed by drying, preferably in a high frequency dryer 28. The glue pattern 27 (FIGS. 6 and 10) applied by the pattern adhesive application means 22 is defined by the raised portions 23 of an applicator roll 25 which is supplied in turn with the adhesive by a pair of swimming or metering rolls 24.

Figure 10:
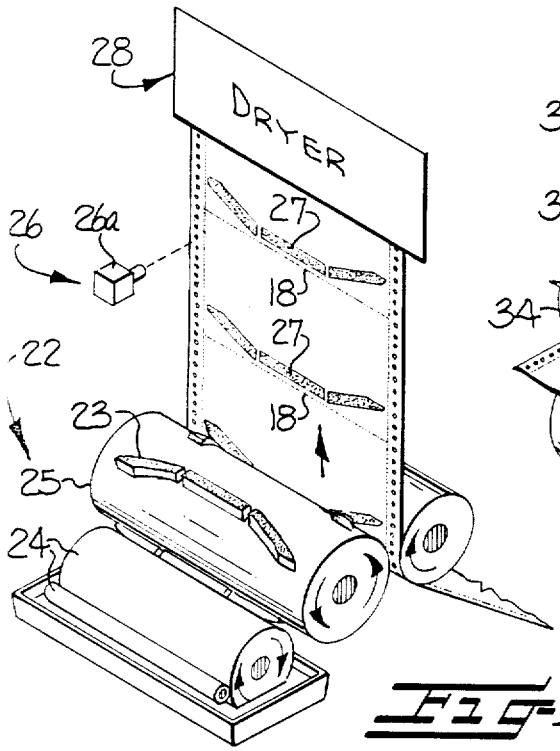
FIG. 10 is a detailed perspective view of the preferred apparatus for applying glue in a pattern on the envelope backing panels.

As shown in FIG. 10, automatic monitoring means 26 are preferably provided including an electric eye 26*a* at the inlet end of the dryer 28 to ensure proper indexing downstream. As alluded to above, registration marks are preferably provided at spaced-apart intervals on the web and which may be read by an electric eye. In operation, the electric eye 26*a* is employed to "read" the registration marks and a pair of variable speed pull wheels 29 (FIG. 5), which are preferably responsive to a signal from the electric eye 26*a* may be used to correct the position of the web as it advances downstream to correct any deviations from a standard and maintain the integrity of the process.

Figure 7:
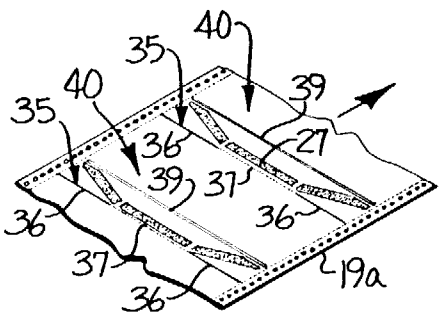

Once the remoistenable adhesive has been applied to the web 10 and dried, the die-cutting steps are performed in accordance with the preferred embodiments of the method and apparatus. To this end, a first die-cutting means 30 (FIG. 11) is provided which preferably comprises a pair of rotatable cylinders 31 and 32. One of the cylinders, cylinder 31 as depicted, mounts transverse cutting blade means 33 and preferably a dulled scoring blade 34 positioned in parallel relation thereto. Each cutting blade means 33 comprises a pair of transversely aligned and separated blades, and defines a transverse line 35 in the web 10 as it impacts the web. The preferred effective circumference of cylinder 31, i.e. measured with the blade mounted thereon, equals seventeen inches. Accordingly, the ends of the blades will be spaced preferably about 5⅔ inches apart to define three such transverse lines 35 with each rotation of the cylinder 31. The transversely separated blades of the cutting blade means 33 form a pair of completely severed segments 36 adjacent each of the ends of the transverse lines 35 and a non-severed medial segment 37 (FIG. 7).

Figure 11:
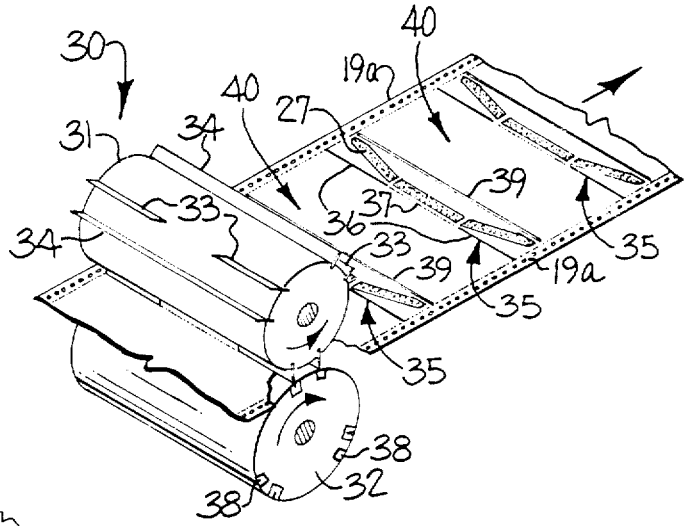
FIG. 11 is a detailed perspective view of the preferred apparatus for concurrently die-cutting and scoring the envelope backing panels so as to sever the web along spaced apart transverse lines.

As best seen in FIG. 11, the severed segments 36 end at the side perforations 19, and do not extend across the marginal edge portions 19*a* of the web. Due to the earlier processing to form the transverse perforations 18 (FIG. 4), the medial segment 37 as well as the marginal edge portions 19*a* of the web 10 will be perforated along the transverse line 35. In this regard, the perforating blade should preferably be at least 50 TPI and up to 70 TPI has been found to be entirely suitable without experiencing undesirable paper breaks at the medial segments 37 at operating speeds of up to about 150 feet per minute. In addition, the length of the perforated medial segment 37 is preferably not more than about 40 percent of the collective length of the medial segment and severed segments 36. As an alternative to the interrupted blade means 33, the transverse perforations 18 provided by perforating means 15 (FIG. 1) may be provided by a modified cutting blade (not shown) wherein the interrupted face of the depicted cutting blade means 33 is augmented by an intermediate as well as marginal perforating blades.

From the above, it will be seen that the steps of severing the advancing web 10 along the longitudinally and regularly spaced apart transverse lines 35, results in the formation of serially arranged generally rectangular backing panels 40 which are defined by the transverse lines 35, and the perforation lines 19 which become the longitudinal opposite side edges of the backing panels 40.

As noted, scoring blade 34, which may suitably be a dulled cutting blade, is also preferably provided on the same cylinder 31 and in parallel relation to the cutting blade means 33. In order to avoid accidentally severing the web 10, rubber inserts 38 are preferably provided in the back-up roll 32 of the first die-cutting means 30 in the areas corresponding to the impact points of the scoring blade 34 (FIG. 11). The resulting score line 39 (FIGS. 7 and 11) defines the fold line for the closure flap of the resulting envelope.

Figure 8:
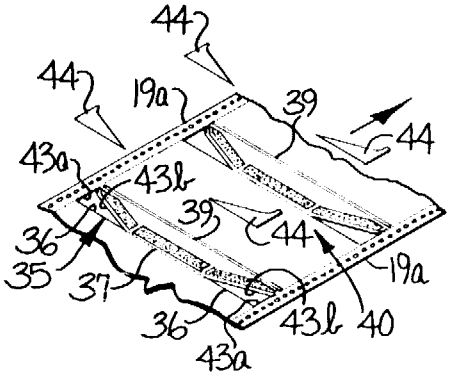
Figure 12:
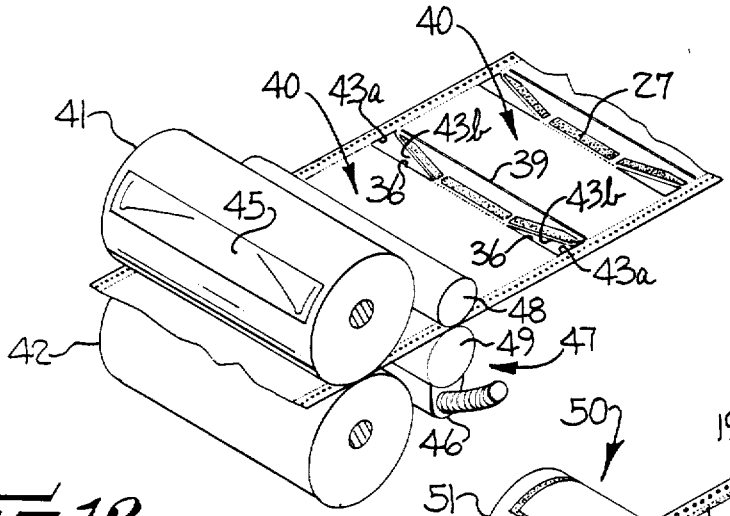
FIG. 12 is a detailed perspective view of the preferred apparatus for severing the advancing web along non-linear lines adjacent each of the transverse lines of FIG. 11.
Figure 19:
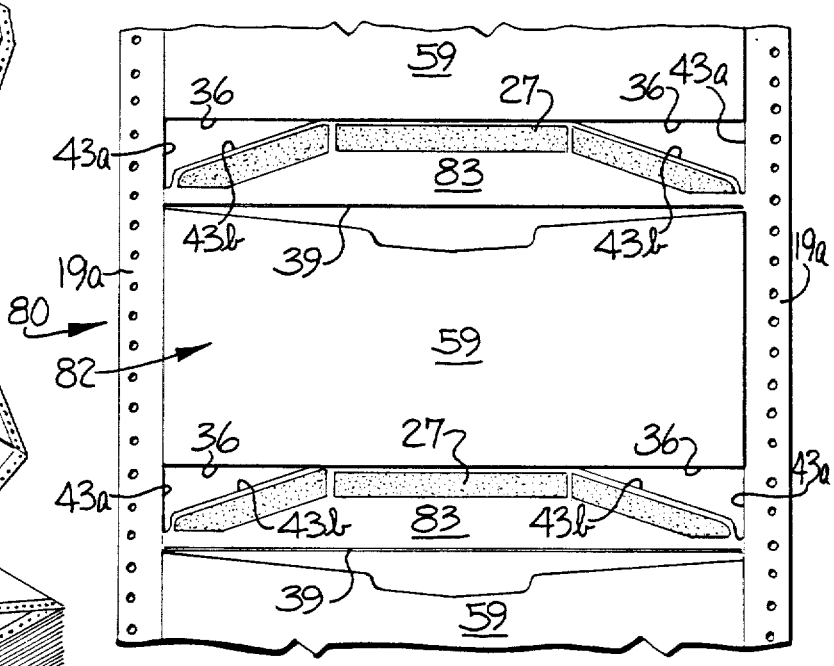
FIG. 19 is a front perspective view of a portion of the continuous envelope product depicted in FIG. 18 on an enlarged scale.

Once the web is severed along a transverse line 35 to provide a pair of severed segments 36 (FIG. 7) adjacent the ends of each transverse line 35, the web is preferably advanced into contact with second die-cutting means in the apparatus, which preferably comprises a pair of rotatable cylinders 41 and 42 (FIG. 12 for detail), where the web is severed along non-linear lines 43 (FIG. 8) adjacent each of the ends of a respective transverse line 35. As best seen in FIG. 19, each non-linear line 43 preferably includes a severed longitudinal segment 43*a* extending substantially perpendicularly from an end of a transverse line 35 and a severed bridging segment 43*b* extending in an oblique direction from the transverse line 35 to the outer end of the associated longitudinal segment 43*a*. The non-linear lines 43 together with the severed segments 36 in any discrete backing panel 40 define a pair of generally triangular cut-outs 44 which are removed following the second die-cutting step. The above described multi-step incision of the envelope backing panels 40 to form the triangular cut-outs 44 permits the formation of elongate triangular or tapered cut-outs heretofore not achievable by conventional methods and apparatus.

The non-linear lines 43 are preferably formed by the use of a flexible sheet metal die 45 (FIG. 12) preferably having a chemically etched or milled surface which provides the pattern of the opposed non-linear line segments 43. The sheet metal die is preferably mounted to the cylinder 41 by magnetic means, in order to facilitate frequent replacements of the flexible dies 45. Sheet metal chemically etched or milled dies of the described type are known in the art, and are manufactured by Atlas ChemMilling Corporation of Elkhart, Ind.

The resulting triangular cut-outs 44 are removed preferably by waste removal means 47 (FIG. 12) which include a foam covered roll 48 and a back-up roll 49 which cooperate to gently separate the cut-outs from the web 10 so that they may be removed by suction means 46 communicating with a waste receptacle (not shown).

Figure 9:
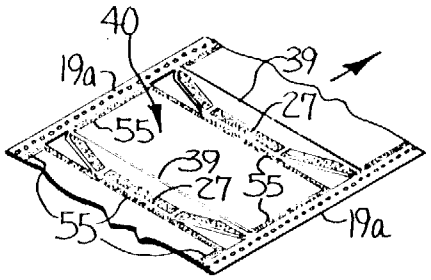
FIGS. 6–9 are perspective views depicting the appearance of the paper web at various intermediate stages as the web is advanced from the left to right through the various treatment steps shown in FIG. 5.
Figure 13:
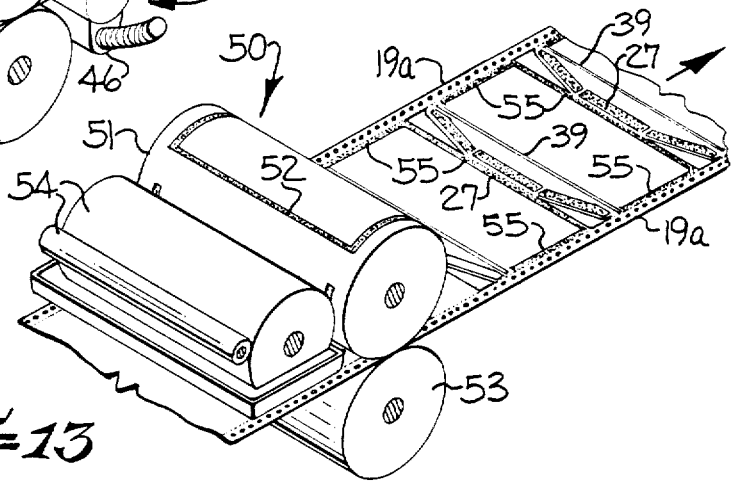
FIG. 13 is a detailed perspective view of the preferred apparatus for applying a relatively thin patterned glue line to each of the envelope backing panels.

Once the envelope backing panels 40 are formed, the process of integrating those panels with discrete envelope patch portions is commenced to complete the continuous envelope product. In accordance with the preferred method and apparatus, glue applicator means 50 (FIGS. 5 and 13) preferably including a patterned glue roll 51, metering rolls 54, and a back-up roll 53, is utilized to apply a relatively thin patterned glue line 55 along the three edges of each envelope backing panel where a patch portion is to be applied. The glue line 55 is defined by the raised pattern 52 provided on the patterned glue roll 51. The pattern 52 is preferably as thin in outline as possible so that the effective interior size of the envelope is maximized. That is, the wider the resulting glue line 55 (FIG. 9), the larger the overall continuous envelope product must be in order to accommodate the particular correspondence or other item to be received in the envelopes. Consequently, the continuous envelope with a larger glue line will have larger dimensions than its counterpart conventional envelope which is folded and glued on its face so that the effective interior size of a conventional envelope is not affected. This is one additional indicia of continuous manufacturing which should preferably be eliminated.

Figure 14:
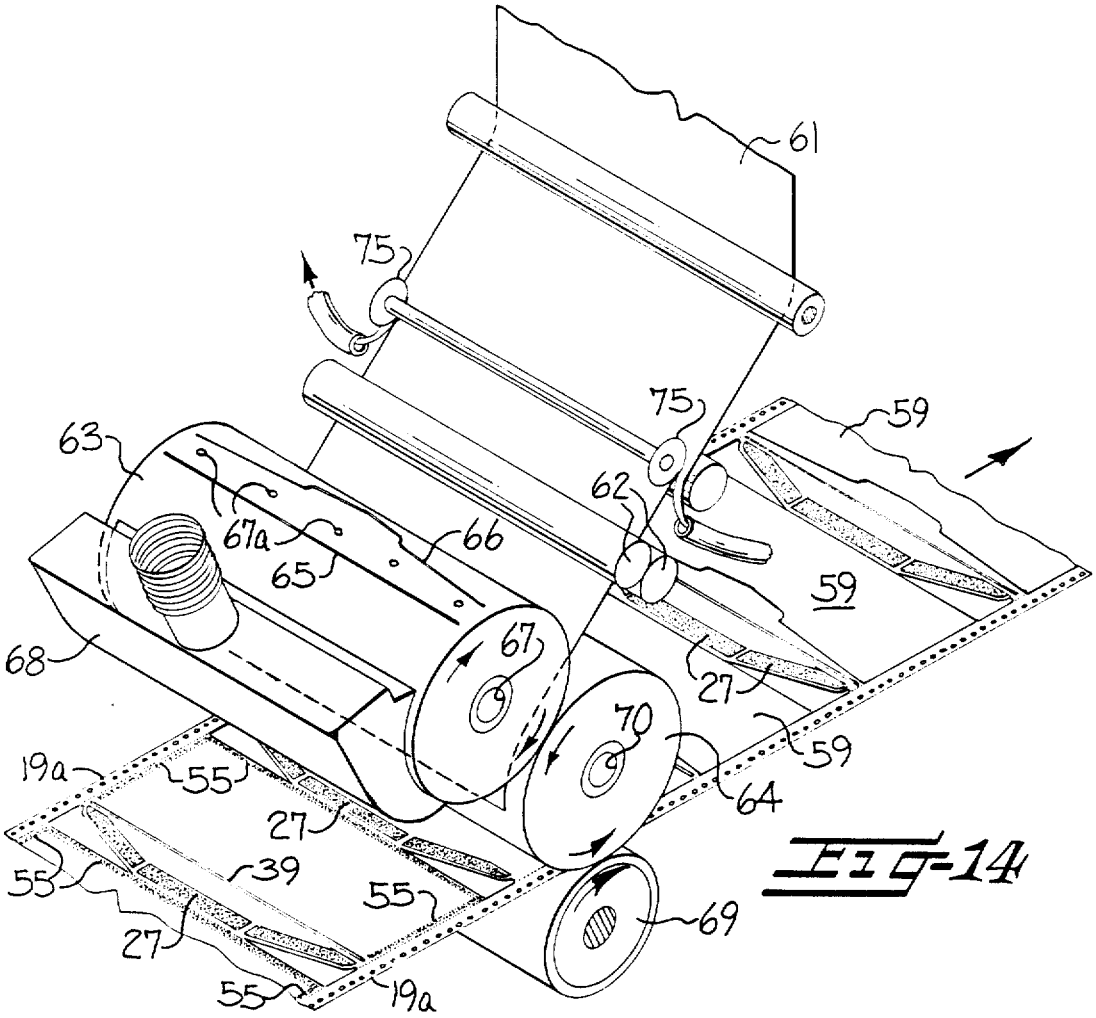
FIG. 14 is a detailed perspective view of the preferred apparatus for advancing and severing a second paper web to provide alternating envelope patch portions and scrap portions with the patch portions being positioned in turn on an advancing first web to form a continuous envelope product.
Figure 16:
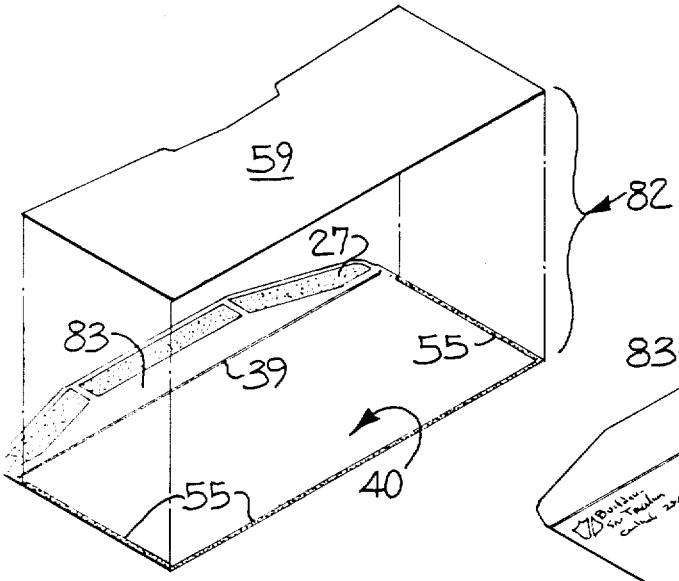
FIG. 16 is an exploded perspective view depicting the preferred envelope product.
Figure 17:
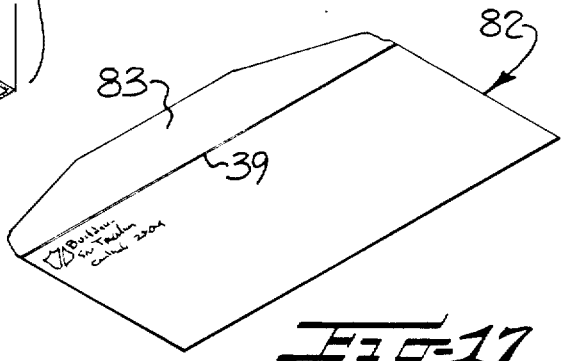
FIG. 17 is a perspective view of the discrete envelope product depicted in FIG. 16 reversed to expose the printing on the envelope.

Once the glue line 55 has been applied, preferably along the transverse bottom edge and opposite side edges of each envelope backing panel 40, the stream of backing panels is ready to receive the envelope patch portions 59 (FIG. 16). The preferred patch portion 59 is formed by patch fabricating and adhering means 60 which includes means for advancing and severing a second web 61 of sheet material preferably comprising a pair of rotatable cylinders 63 and 64 forming a nip (FIG. 14). The web may be first trimmed to the desired patch width, which will vary with the size of the envelope, by conventional slitters 75. In any event, the web 61 is preferably advanced by a pair of pull wheels 62 which, unlike the variable speed pull wheels 29 (FIG. 5), are preferably driven synchronously together with the other driven rolls, and suitably controlled by known gear reducing methods, so that their surface speed matches the speed of the web 10 in operation. Consequently, proper and precise indexing of the severed segments of the web 61 with the web 10 may be accomplished. In this same vein, the circumferences of the preferred cylinders 63 and 64 are preferably the same and should equal the effective circumference of the cutting cylinders 31 and 41, and preferably with a common drive, so that the proper indexing or placement of the patches on the advancing stream of envelope backing panels 40 is further assured.

The cylinder 63 of the patch fabricating means 60 mounts a pair of transverse cutting blades 65 and 66. Blade 66 is preferably slightly V-shaped in outline to provide a corresponding V-shaped incision in the web 61 followed by a second straight transverse cut by blade 65 which provides a waste portion between the transverse blades. The feed rolls 62 should accordingly provide a steady action on the web 61 to maintain the feed to the nip of the rotatable cylinders 63 and 64. Also, the severed waste portion is maintained on the face of roll 63 by intermittent suction means 67 communicating with the waste portion through apertures 67*a*, which are preferably equipped with small rubber suction cups (not shown) with the suction means 67 being calibrated in accordance with the cylinder's rotation to release the formed waste portion to suction waste collecting means 68 communicating with a receptacle (not shown).

Figure 15:
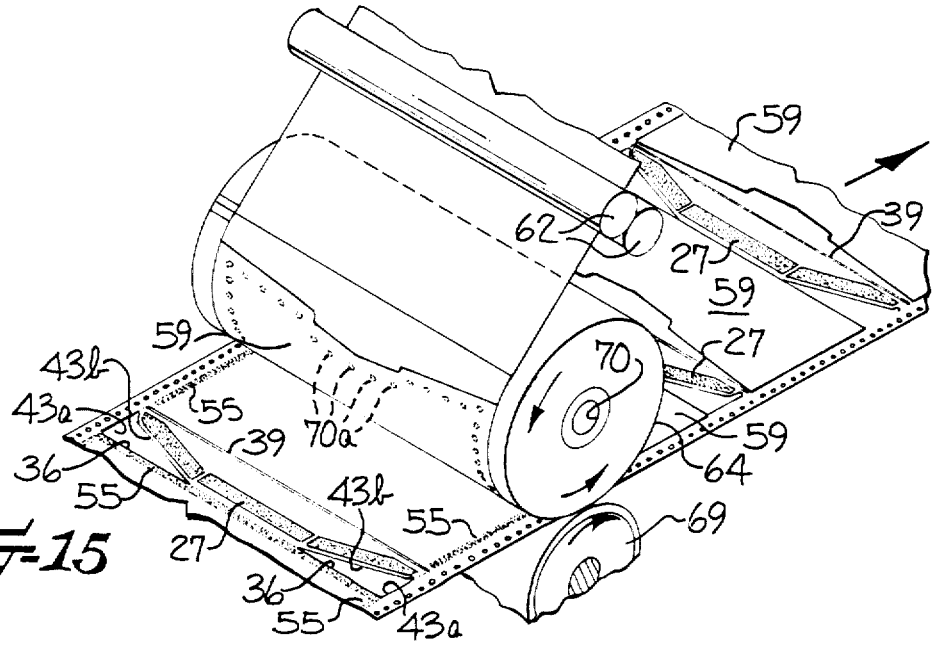
FIG. 15 is a detailed perspective view of the apparatus depicted in FIG. 14 with the preferred die-cutting cylinder removed to expose the means for retaining the formed patch portions on the cylinder for positioning on the first paper web.

As shown in FIG. 15 with cylinder 63 removed, the cut made by transverse blade 66, which is preferably V-shaped in outline as noted above, actually defines the trailing end of a respective, discrete patch portion 59 while the incision made by the straight transverse blade 65 may be considered as initiating the formation of the next discrete patch portion 59 in the series. Therefore, an impact of the blade 65 will define, in corresponding order, a first transverse line which is substantially straight and the preferred V-shaped blade 66 will provide a second transverse line which is, of course, V-shaped in outline. As noted, the waste portion between the two blades are held on roll 63 by the intermittent suction means 67. In a similar vein, intermittent suction is applied by intermittent suction means 70 which apply suction at intervals through apertures 70*a* in the cylinder 64 so that the formed patch portion 59 is continued in its advance without interruption, and may be carefully and accurately positioned serially onto the moving web of fabricated envelope backing panels 40 with the respective side edges and transverse bottom edges in alignment (see FIG. 16) and coinciding with the pattern glue line 55. The envelope backing panels 40 are preferably supported by an additional roll 69 which is preferably rubber-covered and which serves to back-up cylinder 64 and further ensure the accuracy of the patch indexing process.

Figure 18:
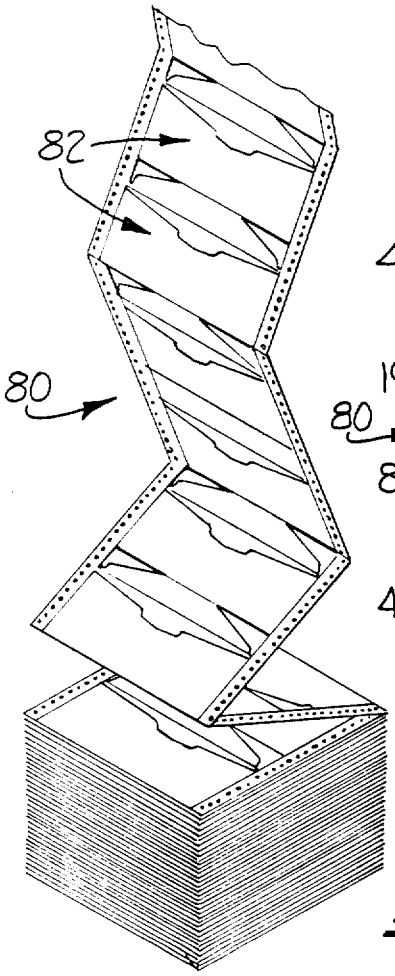
FIG. 18 is a perspective view of the preferred continuous envelope product ready for use in connection with an electronic data processing printer.

The above described method and apparatus results in the formation of a sheet 80 of continuous envelopes, note FIGS. 18–19, and the envelopes may then be counted and folded by folding means 85 as shown schematically in FIG. 5. As will be understood, the resulting sheet 80 is adapted for processing on electronic data processing printers and superficially resembles the familiar stack of computer paper. On closer inspection, however, as shown in FIG. 19, the envelope product 82 includes a closure flap 83 and insert slot which, when the product 82 is separated by a burster or the like, bears a close resemblance to a conventional envelope.

As can readily be seen from the foregoing description of the preferred embodiments of the invention, the above described method and apparatus provides significant advantages over those heretofore known in the art. While the drawings and specification serve to describe the preferred embodiments, they should not be utilized for purposes of unduly limiting the scope of the present invention, which scope is defined solely by the appended claims.

That which is claimed is:

1. A method of fabricating a sheet of continuous envelopes adapted for use in connection with electronic data processing printers and the like, with the envelopes being adapted to be readily separated from the sheet, and comprising the steps of advancing a web of sheet material along a path of travel, passing the advanced web through a nip formed between a first pair of rotating cylinders, with one of the cylinders having transverse cutting blade means mounted thereon positioned perpendicular to the path of travel of the advancing web as it enters the nip, and severing portions of the web along longitudinally and regularly spaced apart transverse lines to provide a pair of straight completely severed segments each positioned adjacent one of the opposed ends of the transverse line while retaining a non-severed medial segment intermediate said severed segments, and with the transverse lines defining a continuous stream of serially arranged generally rectangular envelope backing panels having longitudinal opposite side edges and which are interconnected across the medial segments of the transverse lines, severing the advancing web along a non-linear line adjacent each of the ends of each transverse line, and including passing the advancing web through a nip formed between a second pair of rotating cylinders, with one of the second pair of cylinders mounting a die thereon, with each non-linear line including a completely severed longitudinal segment which extends substantially perpendicularly from the end of the transverse line, and a completely severed bridging segment extending in a substantially oblique direction between the transverse line and the outer end of the associated longitudinal segment, and such that each non-linear line and associated straight severed segment define a generally triangular cut-out, with the two cut-outs along each transverse line being on the same side of such transverse line and being mirror images of each other, and with the severing of the advancing sheet along the non-linear line being conducted at a location along the path of travel which is longitudinally separated from the location at which the advancing sheet is severed along the transverse lines while maintaining the continuity of the formed sheet of envelope backing panels, and adhering a separate generally rectangular patch portion to each of the envelope backing panels of the advancing web, with each patch portion having a bottom edge and two side edges which are aligned respectively with the transverse line opposite the cut-outs and the two side edges of the associated envelope backing panel, and with each patch portion having a top edge which is disposed adjacent the cut-outs, and with each patch portion being adhered to the associated envelope backing panel along such three aligned edges to form an envelope pocket therebetween which opens along the top edge of the patch portion.

2. The method as defined in claim 1 comprising the further step of perforating each of the transverse lines along the length of the medial segment, so as to permit the envelope backing panels to be readily separated from each other by tearing along the medial segment.

3. The method as defined in claim 2 wherein the length of the perforated medial segment is not more than about 40% of the collective length of the medial segment and severed segments along each transverse line.

4. The method as defined in claim 3 comprising the further step of forming a transverse score line across each envelope backing panel of the advancing web, with the score line being positioned closely adjacent the cutouts so as to define an envelope closure flap.

5. The method as defined in claim 4 wherein the step of adhering a patch portion to each of the envelope backing panels includes applying a relatively thin glue line to each of the envelope backing panels of the advancing sheet, and with the glue line extending along the three aligned edges of the patch portion and envelope backing panel.

6. The method as defined in claim 1 wherein the web of sheet material includes marginal edge portions extending longitudinally along and joined to respective side edges of the envelope backing panels, and the method includes the further step of forming spaced apart apertures along the marginal edge portions which are adapted for receiving paper advancing means on a tractor feed mechanism of a printer or the like.

7. The method as defined in claim 6 including the further step of forming a line of perforations across each of said marginal edge portions and which are aligned with each transverse line.

8. The method as defined in claim 7 wherein the step of forming a line of perforations across each of said marginal edge portions is performed concurrently with the step of perforating each of the transverse lines along the length of the medial segment.

9. The method as defined in claim 1 wherein the step of adhering a separate patch portion to each of the envelope backing panels includes advancing a continuous web of patch forming material along a path of travel, severing the advancing web of patch forming material along first and second transverse lines to form a separate patch portion therebetween, and with one of the transverse lines being straight and the other of the transverse lines being slightly V-shaped in outline, and applying the separated patch portions to the advancing web of material with the V-shaped line adjacent the cutouts.

10. A method of fabricating a sheet of continuous envelopes adapted for use in connection with electronic data processing printers and the like, and comprising the steps of advancing a first web of sheet material along a path of travel, with the web comprising serially arranged generally rectangular envelope backing panels, and with each envelope backing panel having a transverse bottom edge, opposite side edges, and a flap portion positioned opposite the associated transverse bottom edge, advancing a second web of sheet material along a path of traval, and completely severing the advancing second web along alternating first and second transverse lines to thereby produce alternating, discrete envelope patch portions and discrete scrap portions, with the envelope patch portions having a transverse bottom edge, a transverse top edge, and opposite side edges, and wherein the step of severing the advancing second web along alternating first and second transverse lines includes passing the advancing web through a nip defined between a pair of rotating cylinders, with one of said cylinders mounting at least one pair of circumferentially separated transverse cutting blades with one of the blades in each pair having a slightly V-shaped outline, and with the second of said rotating cylinders being disposed tangent to said path of travel of said first web, and such that the surface of the second of said rotating cylinders moves in the same direction and at the same speed as said advancing web at the tangent point, supporting each envelope patch portion on the surface of the second of said rotating cylinder so that each envelope patch portion is conveyed by the rotating cylinder from the nip onto the advancing first web and so that each envelope patch portion is superimposed over an envelope backing panel with the straight transverse bottom edge of the patch portion aligned with the bottom edge of the envelope backing panel, and with the transverse top edge being adjacent the flap portion of the envelope backing panel, and with the respective side edges being aligned, and adhering each of the envelope patch portions to its associated envelope backing panel along the aligned transverse bottom and side edges to form a pocket therebetween which includes an insert opening.

11. The method as defined in claim 10 comprising the further steps of supporting each scrap portion on the surface of the other rotating cylinder so that each scrap portion is conveyed from the nip to the side of the other cylinder opposite the nip, and then withdrawing each scrap portion from the other cylinder and conveying the scrap portion to a waste receptacle.

12. An apparatus for fabricating a sheet of continuous envelopes adapted for use in connection with electronic data processing printers and the like, with the envelopes being adapted to be readily separated from the sheet, and comprising:

means for advancing a web of sheet material along a path of travel, first cutting means comprising a first pair of rotatable cylinders forming a nip therebetween, with one of the cylinders having transverse cutting blade means mounted thereon positioned perpendicular to the path of travel of the advancing web as it enters the nip, for severing portions of the advancing web along longitudinally and regularly spaced apart transverse lines, and such that each transverse line includes straight completely severed segments adjacent each of the ends of the transverse line and a non-severed medial segment intermediate said severed segments, and with the transverse lines defining a continuous stream of serially arranged generally rectangular envelope backing panels having longitudinal opposite side edges and which are interconnected across the medial segments of the transverse lines, second cutting means, positioned in longitudinally spaced apart relation along the path of travel from said first cutting means and comprising a second pair of rotatable cylinders forming a nip therebetween, with one of the second pair of cylinders mounting a die thereon, for severing the advancing web along a non-linear line adjacent each of the ends of each transverse line, with each non-linear line including a completely severed longitudinal segment which extends substantially perpendicular from the end of the transverse line, and a completely severed bridging segment extending in a substantially oblique direction between the transverse line and the outer end of the associated longitudinal segment, and such that each non-linear line and associated severed segment define a generally triangular cut-out, with the two cut-outs along each transverse line being on the same side of such transverse line and being mirror images of each other, and means for adhering a separate generally rectangular patch portion to each of the envelope backing panels of the advancing web, with each patch portion having a bottom edge and two side edges which are aligned respectively with the transverse line opposite the cut-outs and the two side edges of the associated envelope backing panel, and with each patch portion having a top edge which is disposed adjacent the cut-outs, and with each patch portion being adhered to the associated envelope backing panel along such three aligned edges to form an envelope pocket therebetween which opens along the top edge of the patch portion.

13. The apparatus as defined in claim 12 wherein the said one cylinder of the second pair mounting the die includes magnetic means for mounting the die on said cylinder and wherein said die comprises a metal sheet having a surface defining the outline of the non-linear lines.

14. The apparatus as defined in claim 13 further comprising means for perforating each of the transverse lines of the advancing web along the length of the medial segment, so as to permit the envelope backing panels to be readily separated from each other by tearing along the medial segment.

15. The apparatus as defined in claim 14 further comprising means for forming a transverse score line across each envelope backing panel of the advancing web, with the score line being positioned closely adjacent the cut-outs so as to define an envelope closure flap.

16. The apparatus as defined in claim 15 wherein said means for forming a transverse score line comprises a scoring blade mounted on said one of said rotatable cylinders having said transverse cutting blade means rigidly mounted thereon, said scoring blade being mounted in parallel relation to said transverse cutting blade means.

17. The apparatus as defined in claim 15 wherein said means for adhering a patch portion to each of the envelope backing panels includes means for applying a relatively thin glue line to each of the envelope backing panels of the advancing web, and with the glue line extending along the three aligned edges of the patch portion and envelope backing panel.

18. The apparatus as defined in claim 17 further comprising means for forming spaced apart apertures along the marginal edge portions of the advancing web and which are adapted for receiving paper advancing means on a tractor feed mechanism of an electronic printer or the like.

19. The apparatus as defined in claim 17 wherein the means for adhering a separate patch portion to each of the envelope backing panels includes means for advancing a continuous web of patch forming material along a path of travel, means for severing the advancing web of patch forming material along first and second transverse lines to form a separate patch portion therebetween, and with one of the transverse lines being straight and the other of the transverse lines being slightly V-shaped in outline, and means for applying the separated patch portions to the advancing web of material with the V-shaped line adjacent the cutouts.

20. An apparatus for fabricating a sheet of continuous envelopes adapted for use in connecting with electronic data processing printers and the like, and comprising:

means for advancing a first web of sheet material along a path of travel, with the web comprising serially arranged generally rectangular envelope backing panels, and with each envelope backing panel having a transverse bottom edge, opposite side edges, and a flap portion positioned opposite the associated transverse bottom edge, means for advancing a second web of sheet material along a path of travel and for completely severing the advancing second web along alternating first and second transverse lines, to thereby produce discrete alternating envelope patch potions and discrete scrap portions, with the envelope patch portions having a transverse bottom edge, a transverse top edge, and opposite side edges, and comprising a pair of rotatable cylinders forming a nip therebetween, with one of said cylinders mounting at least one pair of circumferentially separated transverse cutting blades with one of said blades in each pair having a slightly V-shaped outline, and with the second of said rotatable cylinders being disposed tangent to said path of travel of said first web, and such that the surface of the second of said rotatable cylinders moves in the same direction and at the same speed as said advancing web at the tangent point, means for supporting the resulting envelope patch portions on the surface of the second of said rotatable cylinders for continuing without interruption the advance of the envelope patch portions to said tangent point with said advancing web so that the patch portions are positioned serially upon the advancing web by said second rotatable cylinder and so that each envelope patch portion is superimposed over an envelope backing panel with the straight transverse bottom edge of the patch portion aligned with the bottom edge of the envelope backing panel, and with the transverse top edge being adjacent the flap portion of the envelope backing panel, and with the respective side edges being aligned, and means for adhering each of the envelope patch portions to its associated envelope backing panel along the aligned transverse bottom and side edges to form a pocket therebetween which includes an insert opening.

21. The apparatus as defined in claim 20 further comprising vacuum means for supporting each scrap portion on the surface of said cylinder mounting the cutting blades so that each scrap portion is conveyed away from the nip, and means for withdrawing each scrap portion from the cylinder and for conveying the scrap portion to a waste receptacle.

* * * * *

UNITED STATES PATENT AND TRADEMARK OFFICE

CERTIFICATE OF CORRECTION

PATENT NO. : 4,726,804

DATED : 2/23/88

INVENTOR(S) : Robert S. Stitcher

It is certified that error appears in the above-identified patent and that said Letters Patent is hereby corrected as shown below:

Column 3, line 43, after "in" insert -- accordance --

Column 12, line 40, delete "17" and insert -- 12 --

Signed and Sealed this

Fifth Day of July, 1988

*Attest:*

*Attesting Officer*

DONALD J. QUIGG

*Commissioner of Patents and Trademarks*